United States Patent [19]

McCreery

[11] Patent Number: 4,479,633

[45] Date of Patent: Oct. 30, 1984

[54] TELESCOPIC DIFFERENTIAL COLUMN HYDRAULIC CYLINDER

[75] Inventor: Robert B. McCreery, Xenia, Ohio

[73] Assignee: The Marmac Company, Xenia, Ohio

[21] Appl. No.: 409,567

[22] Filed: Aug. 19, 1982

[51] Int. Cl.[3] ..... B66F 3/24

[52] U.S. Cl. ..... 254/93 R

[58] Field of Search ..... 187/9 E, 9 R; 92/53; 254/93 R, 2 R, 2 B, 2 C, 92

[56] References Cited

U.S. PATENT DOCUMENTS

| | | | |
|---|---|---|---|
| 2,634,587 | 4/1953 | Ptak | 92/108 |
| 2,666,501 | 1/1954 | Abbe | 187/9 E |
| 3,181,436 | 5/1965 | McCreery | 92/111 |

*Primary Examiner*—Frederick R. Schmidt
*Assistant Examiner*—Judy J. Hartman
*Attorney, Agent, or Firm*—Harvey B. Jacobson

[57] ABSTRACT

A first elongated support member is provided and includes second large and small outside cross-sectional area end portions. A cylinder member is provided and includes large and small end portions sealingly and slidingly engaged with the large and small diameter end portions, respectively, of the first support member and defining a peripheral expansion chamber between the support member and the second cylinder member. Structure is provided operative to admit and evacuate fluid under pressure to and from the expansion chamber. A third cylinder member is provided including base and far ends sealingly and slidingly engaged with the large and small end portions of the second cylinder member and with a peripheral expansion zone being defined between the second cylinder member and the third cylinder member between the base and far ends portions of the third cylinder member. Further, structure is provided establishing communication between the expansion chamber and the expansion zone. The first elongated support member is considerably longer than the second cylinder member and the latter is longer than the third cylinder member.

8 Claims, 7 Drawing Figures

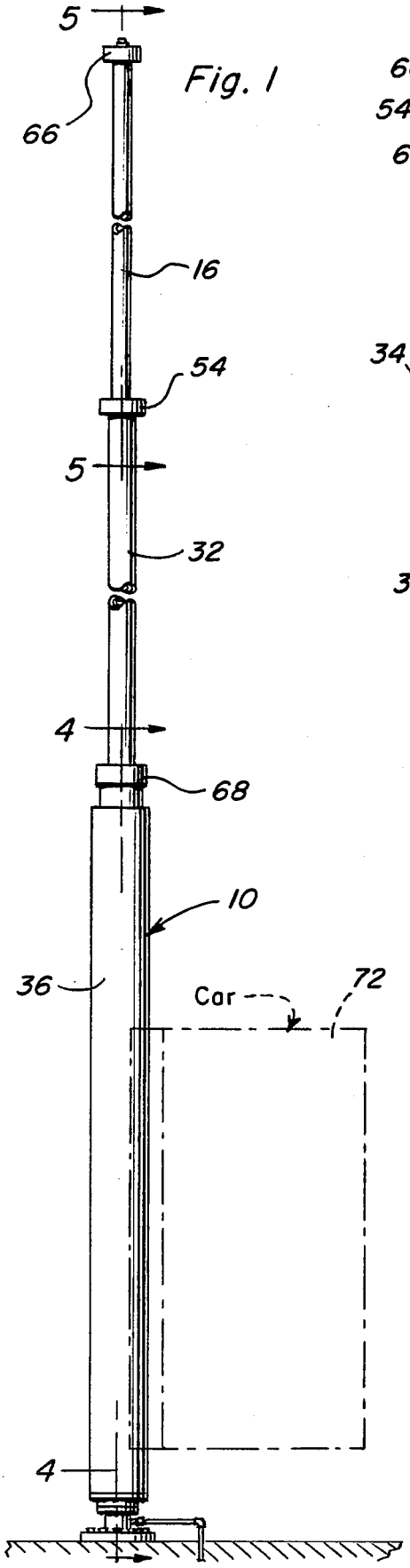
Fig. 1
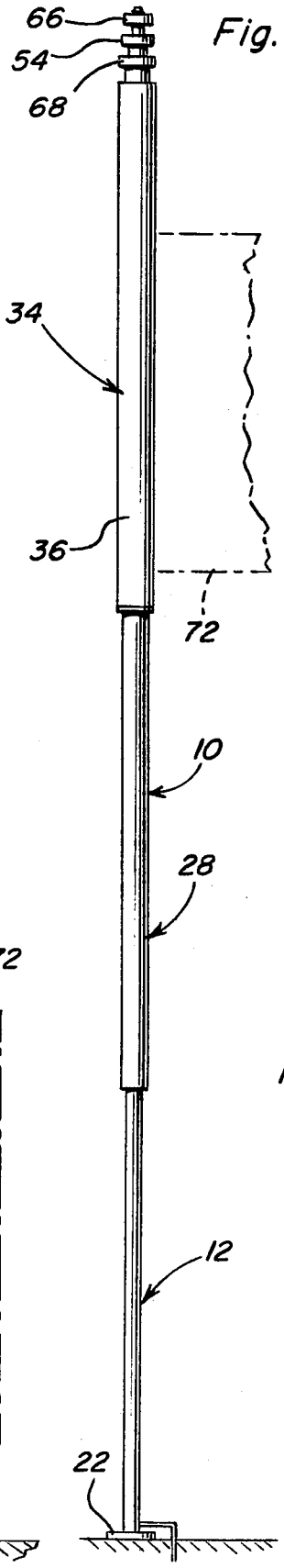
Fig. 2
Fig. 3
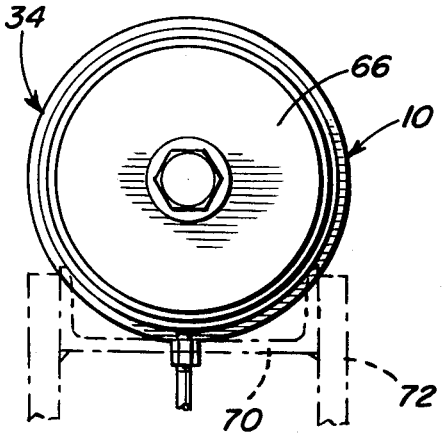
Fig. 6
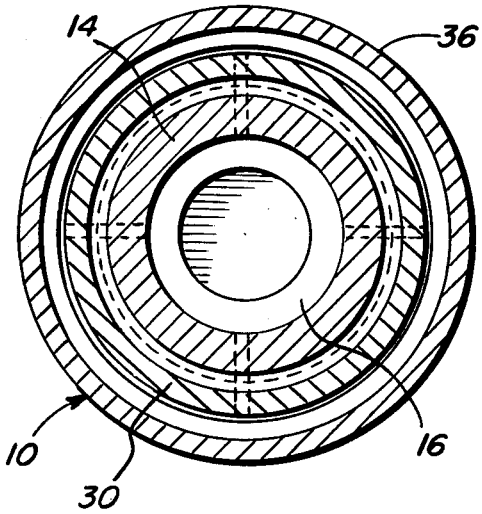
Fig. 7
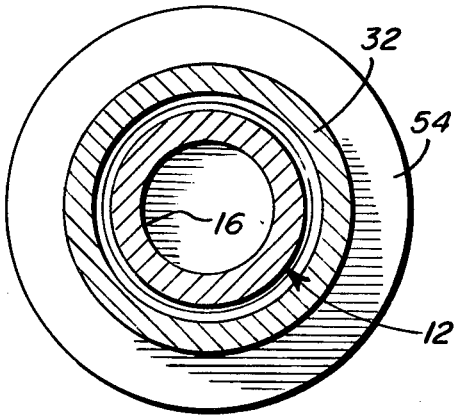

16
32
52
46
68
48
38
40
32
64
18
62
34
62
10
14
28
6
6
58
36
60
30
48
44
46
42
50
20
12
26
56
26
24
22

66
16
54
42
44
32
7
7

TELESCOPIC DIFFERENTIAL COLUMN HYDRAULIC CYLINDER

BACKGROUND OF THE INVENTION

Differential hydraulic cylinders of various design heretofore have been used in environments requiring long extension and retraction distances and in most cases serially arranged cylinder and piston components have been used to accomplish extension and retraction distances or relatively great magnitude. However, conventional multistage cylinders of this type are not adaptable for use in conjunction with loads which are eccentrically applied to the pistons.

In addition, various different forms of cylinders have been specifically designed for use in conjunction with eccentrically disposed loads but most of these cylinders are constructed in a manner which greatly limits extension and retraction distances.

Accordingly, a need exists for an improved form of differential hydraulic cylinder which may be used to support eccentrically disposed loads such as elevator cars or platforms and yet which will be capable of raising and lowering the cars or platforms used in conjunction therewith over relatively great distances.

Examples of various forms of cylinders including some of the general structural and operational features of the instant invention are disclosed U.S. Pat. Nos. 2,634,587, 2,670,811, 3,134,231 and 3,181,436.

BRIEF DESCRIPTION OF THE INVENTION

The cylinder construction of the instant invention is specifically designed to be used in a substantially vertical position and with an elevator car or platform eccentrically mounted relative to the vertically extendible and retractable portion of the cylinder assembly. However, the cylinder assembly may be used in shorter lengths while in a horizontal position or an inclined position.

The cylinder assembly includes a central first elongated support member including large and small diameter outside cross-sectional end portions. A second cylinder member including large and small diameter end portions is sealingly and slidingly engaged with the large and small diameter end portions respectively of the support member and a third cylinder member including large and small diameter end portions is sealingly and slidingly engaged with the large and small diameter ends of the second cylinder member. A peripheral expansion chamber is defined between the outer surfaces of the support member and the inner surfaces of the second cylinder member and a peripheral expansion zone is defined between the outer surfaces of the second cylinder member and the inner surfaces of the third cylinder member. The opposite end portions of the second and third cylinder members are provided with bearings and seals slidingly engaged with the small and large diameter end portions of the support member and second cylinder member, respectively, and the upper end portions of the support member and the second cylinder member are provided with abutments with which the upper end portions of the second and third cylinder members are abuttingly engageable while the lower extremities of the small diameter end portions of the second and third cylinder members are abuttingly engaged with the upper extremities of the large diameter end portions of the support and first cylinder members to limit downward retraction of the second and third cylinder members.

The main object of this invention is to provide a multistage cylinder construction having a large extension and retraction range and yet which may be eccentrically loaded when disposed in a vertical position.

Another object of this invention is to provide a cylinder construction in accordance with the preceding object and constructed in a manner whereby the various extendible and retractable sections thereof enjoy a fixed spatial relationship between opposite end seals and bearings thereof slidably engaged with corresponding adjacent cylinder sections.

Yet another object of this invention is provide a cylinder construction whose opposite ends may be stationarily anchored relative to stationary supporting structures therefor.

A final object of this invention to be specifically enumerated herein is to provide a cylinder construction in accordance with the preceding objects and which will conform to conventional forms of manufacture, be of simple construction and easy to service so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of the cylinder construction of the instant invention in a fully retracted position;

FIG. 2 is a side elevational view similar to FIG. 1 but with the cylinder construction in a fully extended position;

FIG. 3 is an enlarged top plan view of the cylinder assembly;

FIG. 6 is a horizontal sectional view taken substantially upon the plane indicated by the section line 6—6 of FIG. 4; and FIG. 7 is a horizontal sectional view taken substantially upon the plane indicated by the section line 7—7 of FIG. 5.

DESCRIPTION OF THE PREFERRED EMBODIMENT

Figure 4:
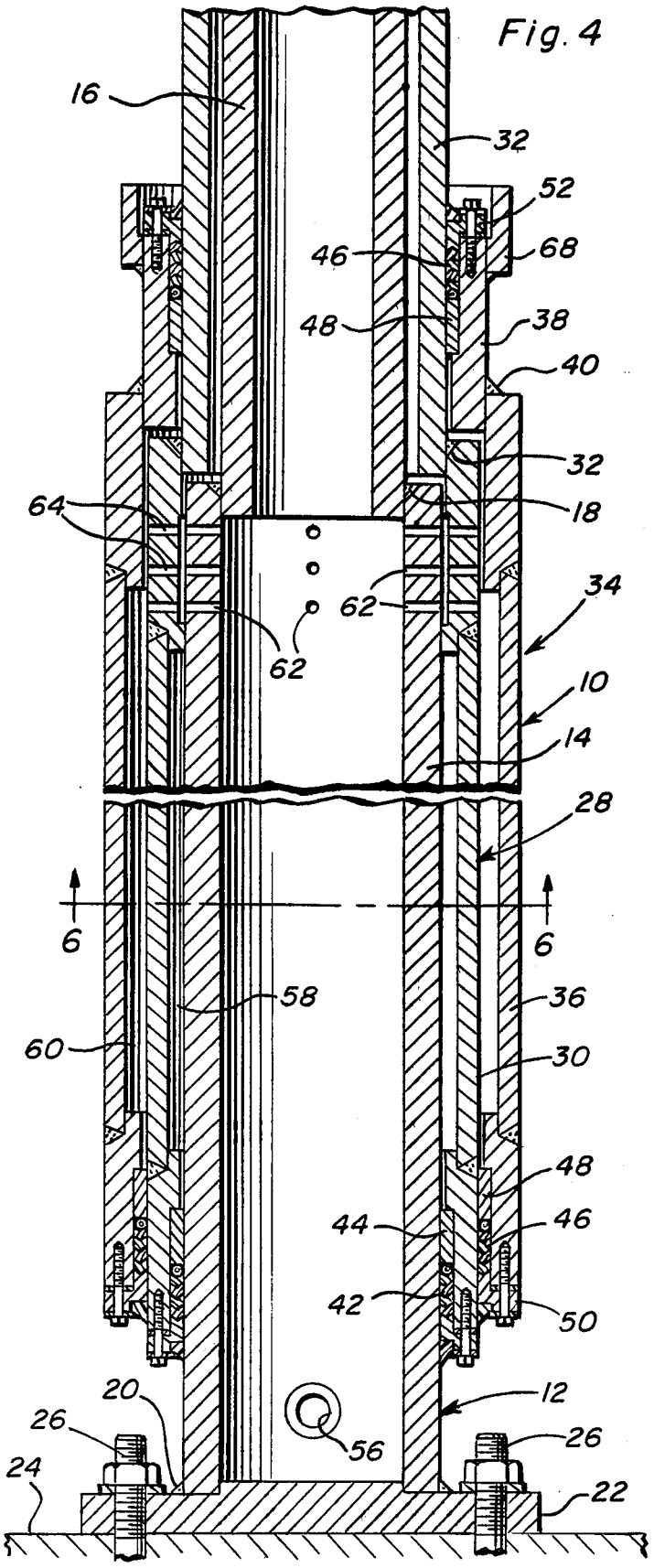
FIG. 4 is an enlarged fragmentary vertical sectional view taken substantially upon the plan indicated by the section line 4—4 of FIG. 1.
Figure 5:
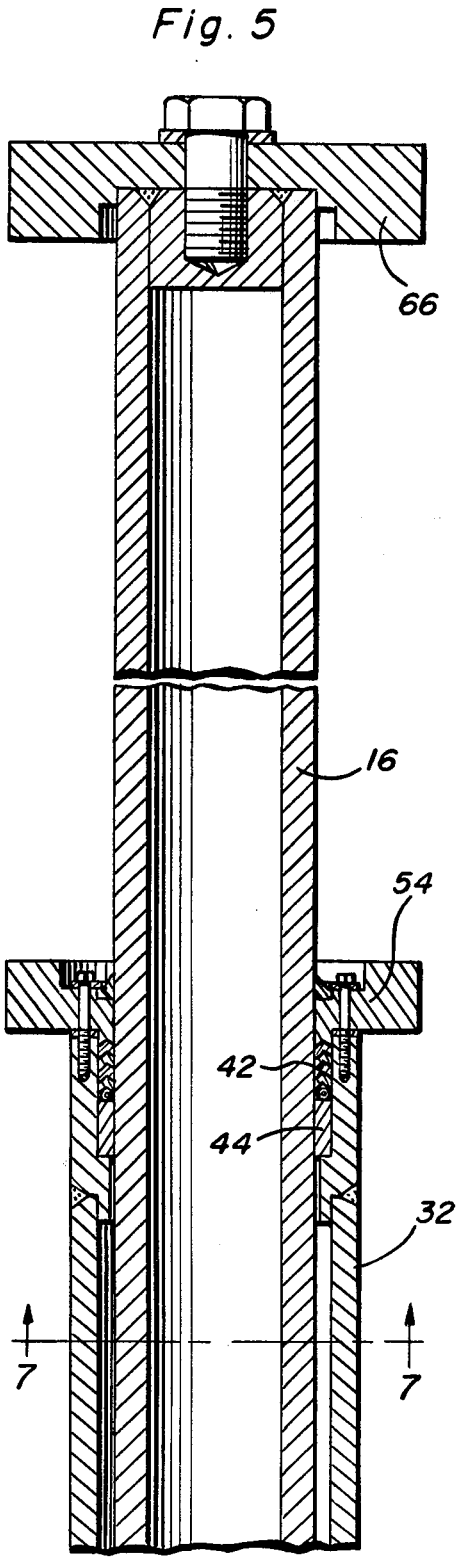
FIG. 5 is an enlarged fragmentary vertical sectional view taken substantially upon the plan indicated by the section line 5—5 of FIG. 1.

Referring now more specifically to the drawings, the numeral 10 generally designates the telescopic differential column hydraulic cylinder of the instant invention. The cylinder 10 includes a first elongated upstanding tubular support member referred to in general by the reference numeral 12 and including telescopically engaged large and small diameter lower and upper end portions 14 and 16. The lower end portion of the upper end 16 is snugly telescoped into the upper end portion of the lower end portion 14 and securely welded therein as at 18. Further, the lower end of the lower end portion 14 is secured by welding 20 to a support base 22. The support base 22 may be anchored relative to a suitable support surface 24 by fasteners 26, see FIG. 4.

The cylinder additionally includes a second elongated and upstanding cylinder member referred to in general by the reference numeral 28 and including a large diameter lower end portion 30 and a small diameter upper end portion 32. The small diameter upper end portion 32 is slightly downwardly snugly telescoped into the upper end of the lower end portion 30 and welded in position as at 32 and the end portions 30 and 32 are slidable along the end portions 14 and 16.

A third cylinder member referred to in general by the reference numeral 34 is provided and includes a large diameter lower end portion 36 and a small diameter upper end portion 38. The lower end of the upper end portion 38 is downwardly snugly telescoped into the upper end of the lower end portion 36 and welded in position as at 40 and the end portions 36 and 38 are slidably disposed on the end portions 30 and 32.

The lower and upper extremities of the end portions 30 and 32 of the second cylinder member 28 include removable seals and bearings 42 and 44 removably supported therefrom and slidably engaged with the outer surfaces of the end portions 14 and 16 of the support member 12 and the lower and upper extremities of the end portions 36 and 38 include seals 46 and bearings 48 removably supported therefrom and slidably engaged with the exterior surfaces of the end portions 30 and 32. Accordingly, all seals and bearings are slidably engaged with external surfaces which may be readily machined even though the cylinder or tube sections engaged thereby may be extremely long. Further, the various seals and bearings are removably secured in place through the utilization of removable annular retaining walls 50 at the lower ends of the second and third cylinder members 28 and 34, by a removable annular retaining wall 52 at the upper end of the third cylinder member 34 and by a removable annular upper end wall and abutment 54 at the upper end of the second cylinder member 28.

The lower extremity of the end portion 14 includes a fluid pressure inlet and outlet 56 and an annular expansion chamber 58 is defined between and extends about the support member 12 between the upper and lower ends of the cylinder member 28 while a similar annular expansion zone 60 is defined between and extends about the cylinder member 28 between the upper and lower ends of the cylinder member 34.

The upper extremity of the end portion 14 includes axially and circumferentially spaced radial fluid flow ports 62 formed therethrough and the upper end of the end portion 30 includes similar radial fluid flow ports 64 formed therethrough.

The lower end of the upper end portion 32 is downwardly abuttingly engageable with the upper end of the lower end portion 14 to limit downward movement of the second cylinder member 28 on the support member 12 and the lower end of the upper end portion 38 is downwardly abuttingly engageable with the upper end of the lower end portion 30 of the second cylinder member 28 to limit downward movement of the third cylinder member 34 relative to the second cylinder member 28. Further, the upper terminal end of the upper end portion 16 includes a downwardly facing abutment 66 rigidly supported therefrom against which the annular abutment 54 is engageable to limit upward movement of the second cylinder member 28 along the support 14 and the upper end of the upper end portion 38 includes an abutment 68 thereon upwardly abuttable against the annular abutment 54 to limit upward movement of the third cylinder member 34 along the second cylinder member 28.

It is pointed out that the upper end abutment 66 of the cylinder 10 may be rigidly attached to a suitable stationary support so that the cylinder member 10 is rigidly attached both at its upper end and at its lower end to a rigid support. The third cylinder member 34 may have a suitable mount 70 supported therefrom, see FIG. 3, and an elevator car or platform 72 may be suitably anchored to the mount 70. It will be noted from FIG. 1 of the drawings that the elevator car or platform 72 will be eccentrically mounted relative to the second cylinder member 34.

It is very important to note that the distance between each set of bearings 44 and 48 remains constant and in this manner the cylinder 10 is constructed to withstand heavy cantilever loading as represented by the car or platform 72. Further, as hereinabove set forth, the seals and bearings all slidably engage external portions of the upper end portions 16 and 32 and the lower end portions 14 and 30. Further, by utilizing the construction of the instant invention, the cylinder 10 may have a working stroke which considerably exceeds one-half the overall length thereof. For example, the cylinder 10 may be constructed with an overall length of 43 feet 6 inches and have a working stroke of 27 feet 3 inches.

In operation, fluid under pressure may be admitted into the end portion 14 whereupon it passes radially outwardly through the ports 62 and 64 and into the expansion zone 60 to elevate the third cylinder member 34 until it reaches it upper limit of movement. Thereafter, the second cylinder member 28 will be elevated until the second cylinder member 28 reaches its uppermost limit position.

The effective cross-sectional areas of the chamber 58 and zone 60 may be varied in size to suit different applications. Under normal circumstances, when the invention is to be used as an elevator power cylinder, the cross-sectional areas of the chamber 58 and the zone 60 will be identical so that there is no change in speed during the raising and lowering stroke and there would be no preceptable transition from one stages to the other. Internal "slow down" devices or orifices could be provided to prevent either cylinder member 28 and 34 from reaching the end of its stroke and causing a metal contact and the consequent shock. Further, the effective cross-sectional areas of the chamber 58 and zone 60 may be varied as required by the load to be lifted and in order to provide optimum pressure-oil requirement. Still further, the column sizes may be adjusted in diameter and strength to provide the load carrying capacity with no change in operation and function and the lower end of the cylinder does not have to be installed below ground in order to provide a substantial lifting and load carrying capacity.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hydraulic cylinder capable of withstanding cantiliver loading, said cylinder including a first elongated support member including large and small outside cross-sectional area end portions, a second cylinder member including large and small inside cross-sectional area end portions sealingly and slidingly engaged with said first support member large and small end portions, respectively, defining a peripheral expansion chamber between said support member and said cylinder member, means operative to admit and evacuate fluid under pressure to and from said expansion chamber, said large and small end portions of said second cylinder member defining large and small outside cross-sectional area end portions, and a third cylinder member including a large cross-sectional area base end and a small cross-sectional area far end sealingly and slidingly engaged, respectively, with said large and small end portions of said second cylinder member and defining a peripheral expansion zone between said second cylinder member and said third cylinder member between said base and far ends, means establishing communication between said chamber zone, the end of said small diameter end portion of said support member remote from the large diameter end portion thereof including an abutment thereon against which the small diameter end portion of said second cylinder member may abut to limit movement of said second cylinder member away from said large end portion of said support member, said small diameter end portion of said second cylinder member including an abutment thereon against which said far end of said third cylinder member may abut, and abutment means operative to limit movement of said second and third cylinders relative to and toward the large end portions of said support and second cylinders members, respectively.

2. The cylinder of claim 1 wherein said support member comprises a tubular member.

3. The cylinder of claim 1 wherein said support member comprises a tubular upstanding post member.

4. The cylinder of claim 3 wherein the large diameter end portion of said support member is disposed lowermost.

5. The cylinder of claim 1 wherein said abutment means includes stepped interiors of said second and third cylinder members for abutting engagement with said large end portions of said support and second members, respectively, to limit movement of said second and third cylinder members toward the large end portions of said support and second cylinder members.

6. The cylinder of claim 1 wherein the large and small of said second and third cylinder members each include bearing and seal structures slidingly engaged with external surfaces of said support and second cylinder members, respectively.

7. The cylinder of claim 6 wherein said third cylinder member includes external mounting means whereby a load supporting member may be mounted thereon.

8. The combination of claim 7 wherein said support member comprises a tubular member and said means operative to admit and evacuate fluid under pressure to and from said expansion chamber includes a combined fluid inlet and outlet port opening into the interior of said support member and lateral ports formed in said support member opening into said expansion chamber.

* * * * *